US005960248A

United States Patent [19]

Ohno

[11] Patent Number: 5,960,248

[45] Date of Patent: Sep. 28, 1999

[54] IMAGE FORMING APPARATUS

[75] Inventor: Yoshinori Ohno, Toyokawa, Japan

[73] Assignee: Minolta Co., Ltd., Osaka, Japan

[21] Appl. No.: 09/095,815

[22] Filed: Jun. 11, 1998

[30] Foreign Application Priority Data

Jun. 16, 1997 [JP] Japan ..... 9-176535

[51] Int. Cl.[6] ..... G03G 21/00

[52] U.S. Cl. ..... 399/410; 399/38; 399/81; 399/82

[58] Field of Search ..... 399/410, 408, 399/38, 81, 82; 270/58.07, 58.08, 58.09, 58.1, 58.11, 58.12, 58.13

[56] References Cited

U.S. PATENT DOCUMENTS 4,891,670 1/1990 Kanbayashi ..... 355/243

5,236,185 8/1993 Taneda et al. ..... 270/53

5,241,517 8/1993 Carolan .

5,700,002 12/1997 Kato et al. ..... 270/58.12

*Primary Examiner*—Richard Moses

*Attorney, Agent, or Firm*—Morrison & Foerster LLP

[57] ABSTRACT

The object of the present invention is to provide a capability to reliably perform stapling, using a simple operation, at a desired position that takes into consideration the image on the recording sheet.

The present invention that attains said object provides an image forming apparatus that records an original document image on a sheet of recording medium, having a designating device that designates a stapling position with reference to the original document image, and a stapling device that binds the recording sheets at a position on them that corresponds to the stapling position designated by means of said designating device.

16 Claims, 10 Drawing Sheets

IMAGE FORMING APPARATUS

This application is based on application No. 9-176535 filed in Japan, the content of which is hereby incorporated by reference.

BACKGROUND OF THE INVENTION

1. Field of the Invention

The present invention pertains to an image forming apparatus equipped with a function in which, after original document images are recorded on sheets of recording medium, said sheets are bound by means of a stapler.

2. Description of the Related Art

An image forming apparatus such as a copying machine equipped with a stapler to bind sheets of recording medium on which images have been formed is currently in general use. One of the following two methods by which to designate the stapling position is adopted in such an image forming apparatus: (1) a method in which the stapling position is designated by means of an operation panel, or (2) a method in which the stapling position is designated at the area at which the recording sheets are ejected.

When using method (1) in which the stapling position is designated by means of an operation panel, it is difficult to designate the stapling position with precision based on its relationship to the image, and the problem arises that binding cannot be performed at the desired position where the orientation of the original document was incorrect. This problem arises because in this method the stapling position is set with reference to the apparatus, and without regard to the original document or to the images on the recording sheets.

In method (2) in which the stapling position is designated at the recording sheet ejection area, it is difficult to designate a proper position based on its relationship to the image, and where the read image is rotated in memory and then recorded on a recording sheet, it is particularly difficult to determine the orientation of the original document, and binding cannot be performed at the desired position. This problem arises because in this method the stapling position is set with reference to the ejected recording sheets, and without reference to the original document or to the images on the recording sheets.

OBJECTS AND SUMMARY

The object of the present invention is to enable stapling to be performed, by means of a simple operation, at a desired position that takes into account the image on the recording sheet.

The present invention comprises an image forming apparatus by which an original document image is recorded on a recording sheet, said image forming apparatus having a designating device that designates a stapling position with reference to the original document image and a stapling device that performs binding of recording sheets at a position on said recording sheets corresponding to the stapling position designated by said designating device.

BRIEF DESCRIPTION OF THE DRAWINGS

These and other objects and features of the present invention will become apparent from the following description of a preferred embodiment thereof taken in conjunction with the accompanying drawings, in which:

FIG. 4(*b*) is a drawing to explain the principle of the stapling position designating mechanism.

FIG. 5(*b*) is a flow chart showing the main routine executed by the CPU.

FIG. 9(*b*) is a drawing to explain the positional relationship between levers 38*a* and 39*a* of the stapling position designating device and the original document.

In the following description, like parts are designated by like reference numbers throughout the several drawings.

DETAILED DESCRIPTION OF THE PREFERRED EMBODIMENT

Figure 1:
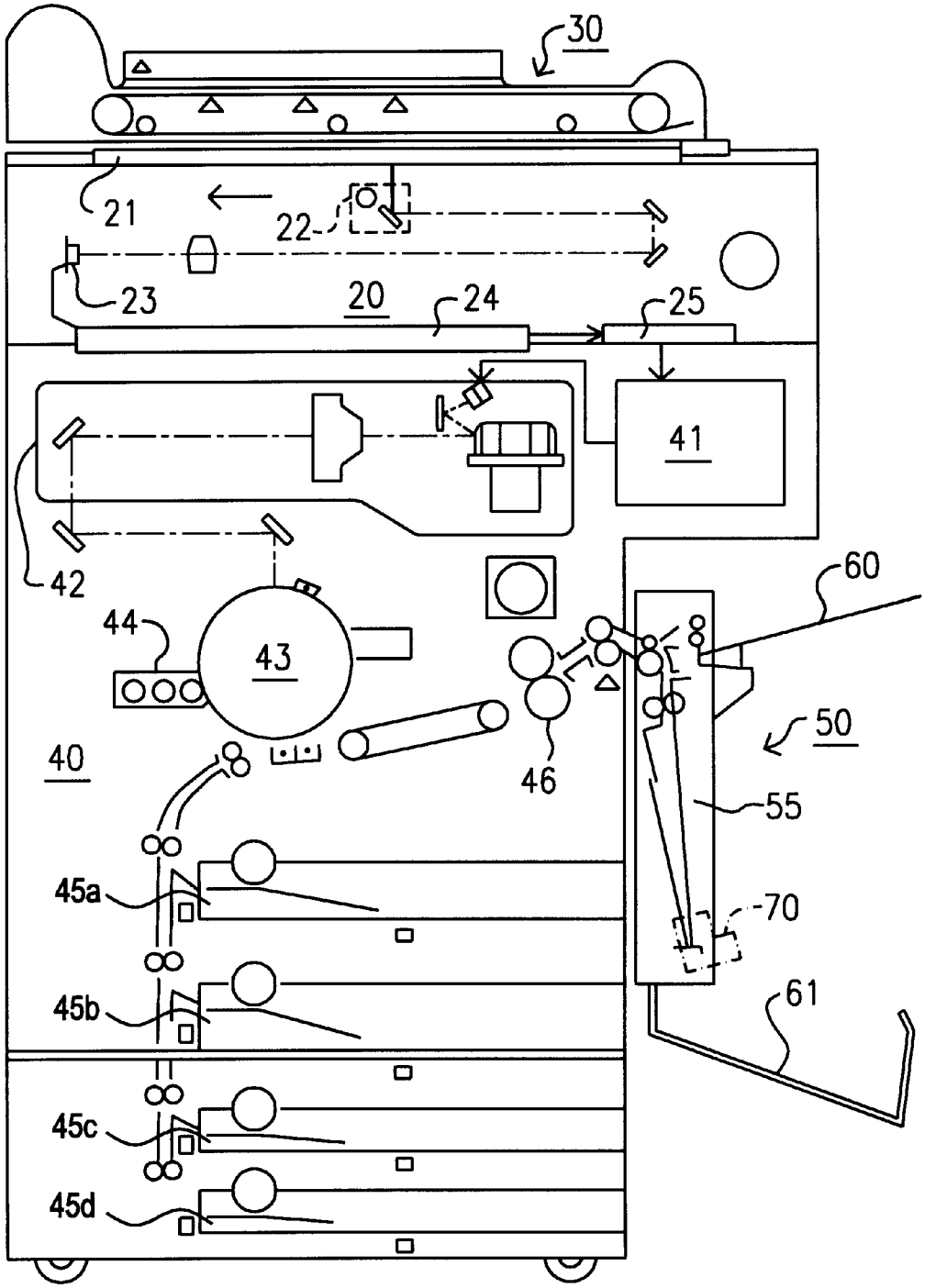
FIG. 1 is a cross-sectional view showing in a simplified fashion the overall construction of a copying machine of one embodiment of the present invention.

FIG. 1 shows the overall construction of a copying machine comprising an embodiment of the image forming apparatus of the present invention. Cyclical automatic original document feeder 30 is located on platen glass 21. Recording sheet processing unit 50 equipped with a stapling function is located at the area where recording sheets as to which image formation has already been performed are ejected from the copying machine main unit.

Figure 5A:
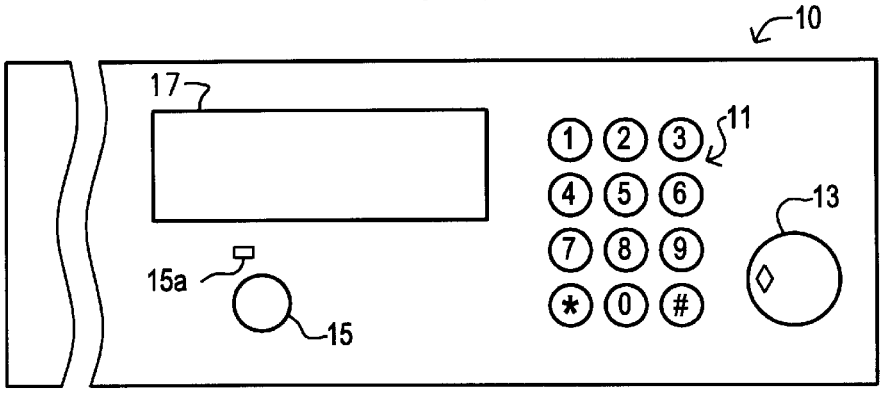
FIG. 5(*a*) is a drawing to explain operation panel 10.
Figure 5B:
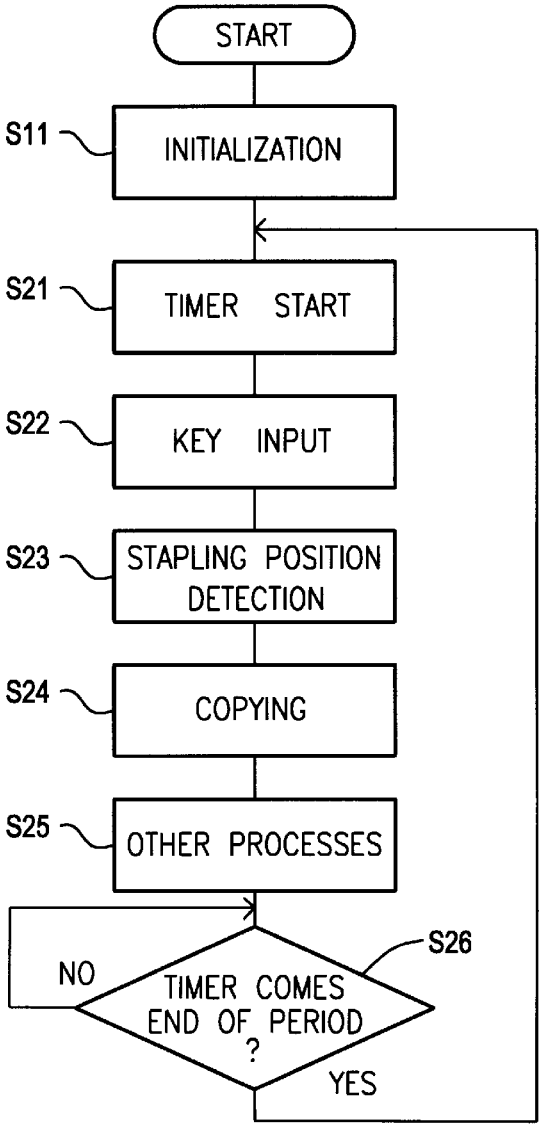

Operation panel 10 shown in FIG. 5(*a*) is located on the front part of the top surface of the copying machine main unit, and includes numeric keypad 11 for inputting numbers, start key 13 that instructs the CPU to begin a copying operation, stapling mode key 15 for setting the stapling mode, stapling mode display LED 15*a* that becomes illuminated to display the current stapling mode setting, liquid crystal display (LCD) unit 17 to perform various other displays, etc.

The copying machine main unit comprises original document reading unit (IR unit) 20 that reads an original document on platen glass 21 and generates image data, and printing unit 40 that forms an image on a recording sheet based on the image data generated by original document reading unit 20.

Original document reading unit 20 generates image data by (i) scanning an original document placed at a prescribed position on platen glass 21 using scanner 22 located beneath platen glass 21, (ii) performing photoelectric conversion by means of CCD 23, and (iii) performing image signal processing using a method in the public domain by means of image signal processing unit 24, and then stores the image data in image memory 25. Control may be performed such that the original document is scanned and read using an original document feeding method in which the scanner does not move. Because this original document feeding method is in the public domain, its explanation will be omitted here. Image editing processes such as magnification, synthesis and rotation are performed in image memory 25 when appropriate. Because these processes are also in the public domain, their explanation will be omitted here.

Printing unit 40 reads out image data from image memory 25 to controller 41, and drives laser device 42 by means of a drive circuit in controller 41 to form an electrostatic latent image on the charged surface of photoreceptor drum 43. This electrostatic latent image is made visible as a toner image by developing device 44 and transferred onto a recording sheet supplied in accordance with a prescribed timing sequence along a paper supply path from one of paper supply trays 45*a* through 45*d*. After the recording sheet onto which the image was transferred is supplied to fusing device 46 for image fusing by means of heat and pressure, it is ejected from the copying machine main unit.

Recording sheet processing unit 50 ejects recording sheets that have undergone the copying operation and have been ejected from the copying machine main unit onto paper eject tray 60, or else houses them in stapling tray 55 and binds them by means of electric stapler 70 after collating them. Switching of the recording sheet destination between paper eject tray 60 and stapling tray 55 is performed by means of switching claw 52 (see FIG. 2) driven by means of a solenoid not shown in the drawings.

Figure 2:
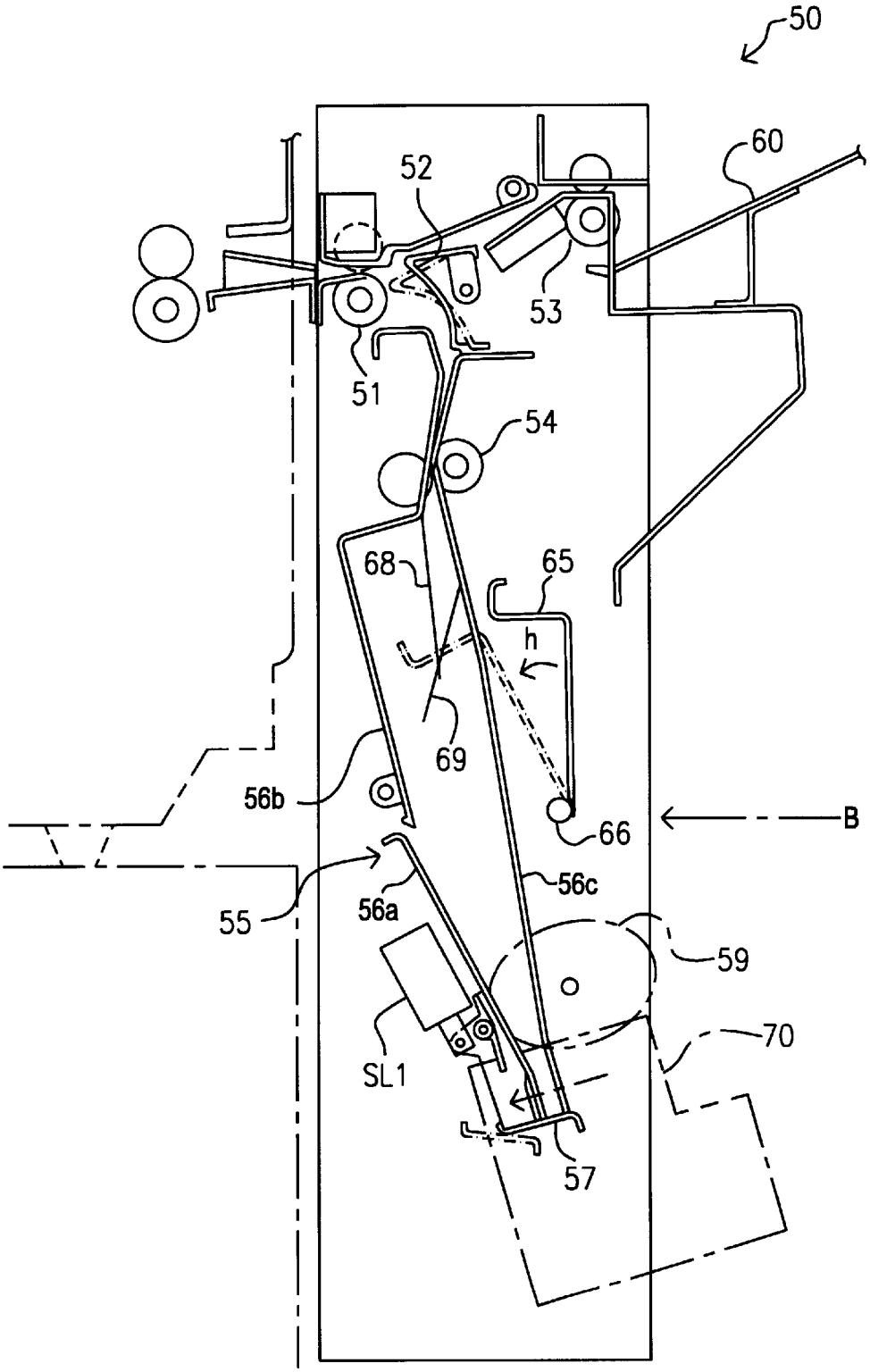
FIG. 2 is a cross-sectional view showing in a simplified fashion the construction of recording sheet processing unit 50 of the copying machine shown in FIG. 1.

For example, where a recording sheet is to be ejected to paper eject tray 60, after the recording sheet is fed in by means of receiving roller 51, it is guided by the top of switching claw 52 set at the position indicated by the two-dot chain line in FIG. 2 and reaches eject roller 53, whereupon it is ejected onto paper eject tray 60 by means of said eject roller 53. On the other hand, where a recording sheet is to be ejected to stapling tray 55, it is guided by the bottom of switching claw 52 set at the position indicated by the solid line in FIG. 2 and reaches housing roller 54, whereupon it is fed into stapling tray 55 by means of said housing roller 54.

Stapling tray 55 has base plate 56*a*, guide plates 56*b* and 56*c* and stopper 57, and stopper 57 is linked to solenoid SL1. In the normal state in which solenoid SL1 is OFF, stopper 57 closes off the bottom of stapling tray 55 and stops the lower edges of the recording sheets housed in stapling tray 55. When solenoid SL1 is turned ON, stopper 57 is retracted to the position indicated by the dashed lines in FIG. 2. As a result, the bottom of stapling tray 55 is opened and the recording sheets housed in said stapling tray 55 fall into stacking bin 61 (see FIG. 1).

Figure 3:
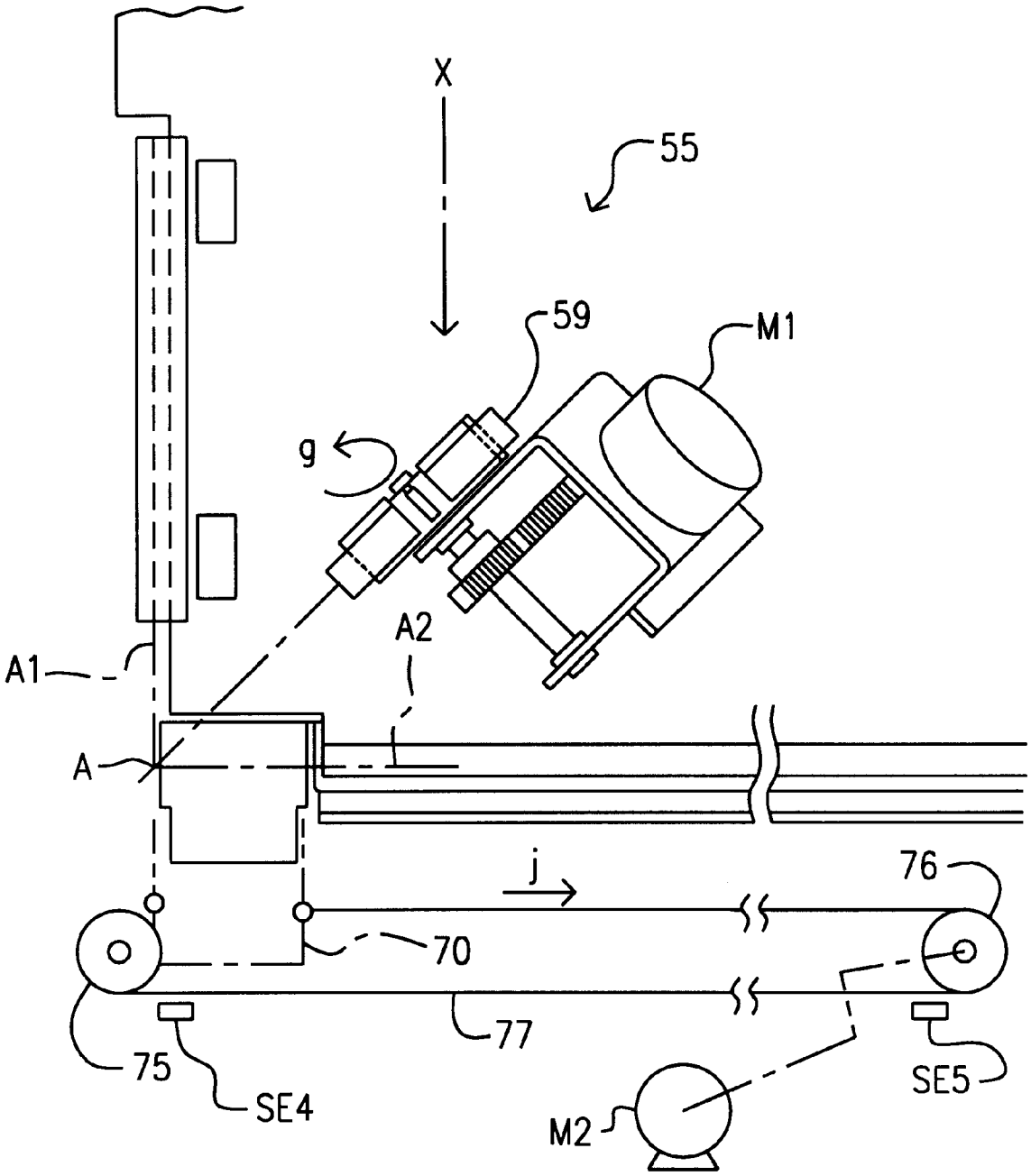
FIG. 3 is a drawing to explain recording sheet processing unit 50 shown in FIG. 2 as seen from the B direction.

Paddle wheel 59 to perform collating of the recording sheets is located on guide plate 56*c*. Paddle wheel 59 comprises multiple blade members attached to the tip of a shaft that rotates by means of motor M1, such that they radiate outward, and rotates in the direction of arrow g due to motor M1 as shown in FIG. 3. As a result of this paddle wheel 59, the recording sheets that are conveyed into stapling tray 55 by means of housing roller 54 as indicated by arrow X receive force in the direction of corner A and are collated one sheet at a time such that they are aligned with horizontal and vertical collating reference axes A1 and A2.

Recording sheet pressure plate 65 is located on stapling tray 55. This pressure plate 65 is rotatably supported by shaft 66, and can move into and retract from stapling tray 55 by means of a solenoid not shown in the drawings. In other words, each time a recording sheet is placed in stapling tray 55, pressure plate 65 rotates in the direction of arrow h and moves into stapling tray 55, and presses the top part of the housed recording sheet against guide plate 56*b*. Immediately before the next recording sheet is placed in stapling tray 55, pressure plate 65 retracts outside stapling tray 55, such that the leading edge of said next recording sheet does not collide with the recording sheets already housed, preventing a paper jam or a disturbance of the page order. In order to ensure the reliability of this effect, belt-shaped resin sheet 68 and electrical discharge brush 69 are located in stapling tray 55.

For stapler 70 to bind the recording sheets, a public-domain electric stapler that contains multiple staples is used. This stapler 70 is linked to wire 77 that stretches around pulleys 75 and 76, and, by means of the drive force of pulley 76 linked to motor M2 that can rotate either forward or backward, moves either in the direction of arrow i (when motor M2 rotates forward) or in the direction opposite arrow i (when M2 rotates backward), and can be stopped at a desired position.

Sensor SE4 that detects that stapler 70 is at the home position is located near pulley 75, and sensor SE5 that detects that stapler 70 has reached the end position is located near pulley 76. Therefore, the position of stapler 70 can be determined based on the amount and direction of rotation of motor M2 after detection of stapler 70 by sensor SE4 or SE5 is performed. In other words, by properly controlling the amount and direction of the rotation of motor M2 after said detection is performed, stapler 70 may be stopped at the desired position for operation.

Figure 4A:
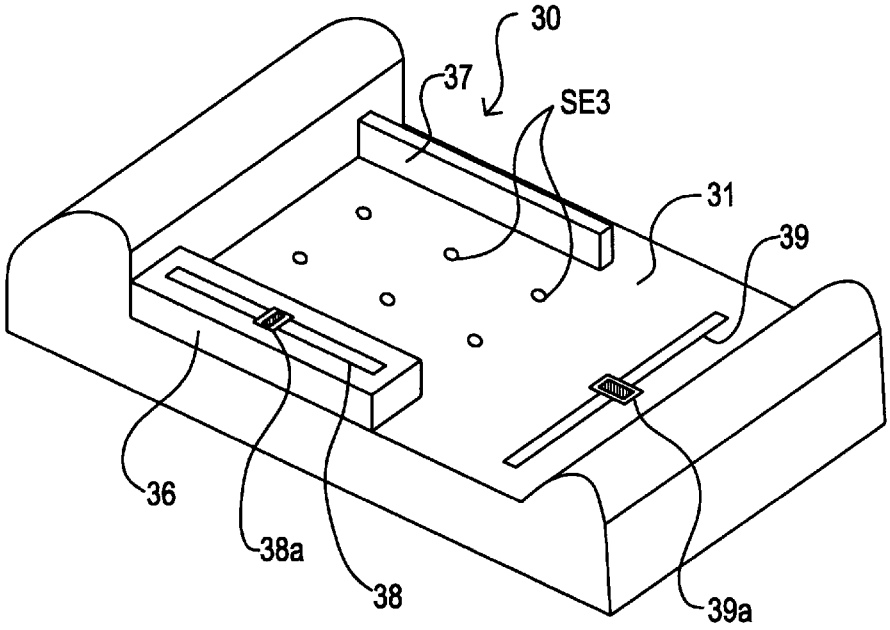
FIG. 4(*a*) is a perspective view showing the basic construction of original document feeder 30.
Figure 4B:
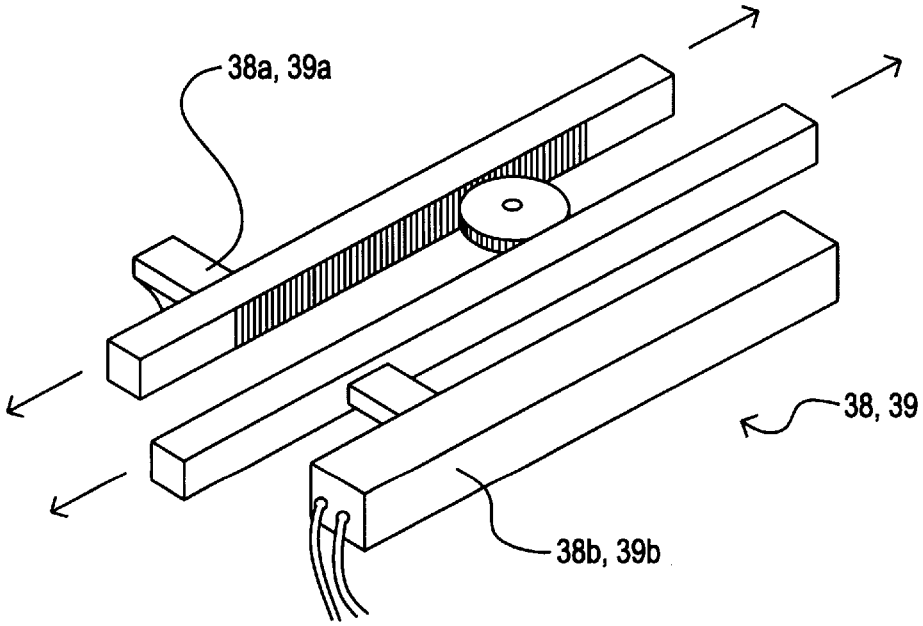

Automatic original document feeder 30 is a device that feeds onto platen glass 21 an original document set in original document tray 31 one sheet at a time, and then removes the sheets from platen glass 21 after scanning is completed. In moving document scanning mode, it conveys the original document onto platen glass 21 at a fixed rate of speed. Because the methods for the automatic supplying, feeding and ejecting of the original document sheets are in the public domain, their explanation will be omitted here. Sensor array SE3 that detects the size of the original document set on original document tray 31 is located in automatic original document feeder 30, as shown in FIG. 4(*a*). Because the method for detecting the size of the original document is in the public domain, its explanation will be omitted here.

Original document guides 36 and 37 to control both original document edges in lateral directions (the directions perpendicular to the direction of conveyance of the original document) are located in automatic original document feeder 30. Original document guide 37 can be manually moved laterally in order to fit the width of the original document, such that it will be at an appropriate position. Original document guide 36 is fixed, and includes stapling position designating device 38 that designates the stapling position in the secondary scanning direction and is equipped with lever 38*a*. Stapling position designating device 39 that designates the stapling position in the main scanning direction and is equipped with lever 39*a* is located at the lower end of original document tray 31.

Stapling position designating device 38 (39) is a device that detects the position of lever 38*a* (39*a*) as a voltage level based on the resistance value of variable resistor 38*b* (39*b*) that is determined in response to the position of lever 38*a* (39*a*), as shown in FIG. 4(*b*). The detected voltage level undergoes A/D conversion and is then input to the CPU (FIG. 9(*a*)). This detecting device is a public-domain device such as that disclosed in Japanese Laid-Open Patent Application Sho 64-3677.

In this copying machine, a desirable stapling position is determined while visually considering its relationship to the original document image placed in original document tray 31, and this stapling position is designated as the intersecting coordinates of lever 38*a* and lever 39*a*. When thus designated, stapler 70 moves to the position corresponding to these coordinates, and the stapling operation is performed at said position. Here, control is performed such that the actual stapling position and the recorded image will have the same relative positional relationship as that between the original document image and the designated stapling position.

The operation of this copying machine will now be explained with regard to the processing performed by the CPU shown in FIG. 9(*a*) to control the timing of the various operations of the copying machine and of stapler 70.

As shown in the drawing, the values detected regarding levers 38*a* and 39*a*, as well as signals from original document size sensor array SE3, sensor SE4 that detects that stapler 70 is at the home position, sensor SE5 that detects that stapler 70 has reached the end of its travel path, operation panel 10 shown in FIG. 5(*a*), etc., are input to the CPU. Drive signals for motor M2 to move stapler 70, signals sent to image reading unit 20 and printing unit 40, signals to control the display on operation panel 10, etc., are output from the CPU. The CPU also reads out image data from image memory 25 and sends it to printing unit 40. Explanation of other I/O signals will be omitted.

Main routine: FIG. 5(*b*)

Figure 9A:
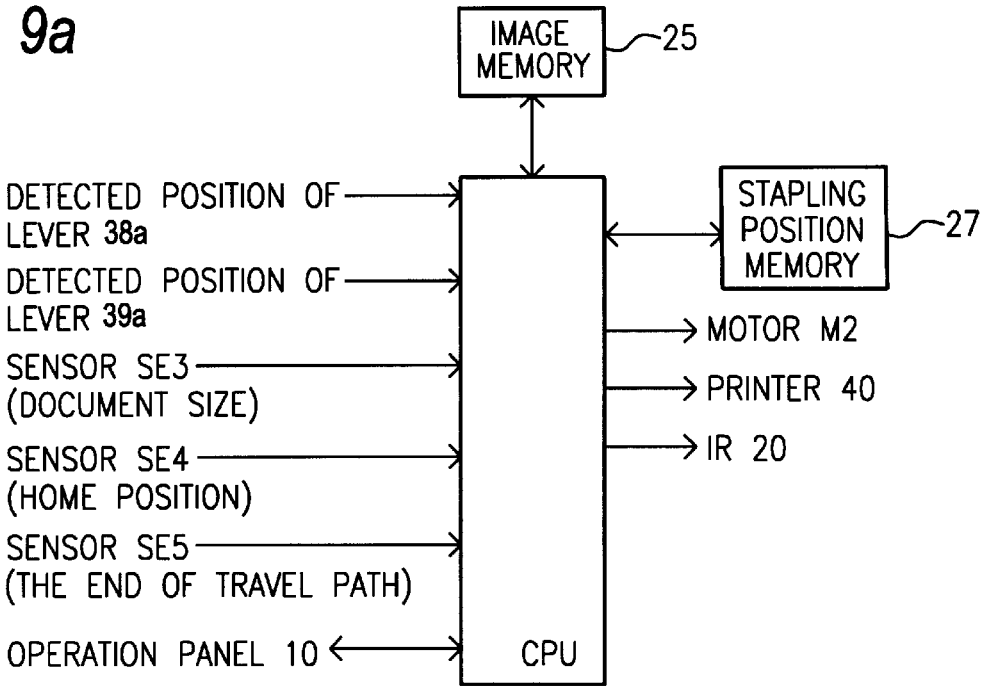
FIG. 9(*a*) is a block diagram showing the I/O arrangement to and from the CPU.
Figure 9B:
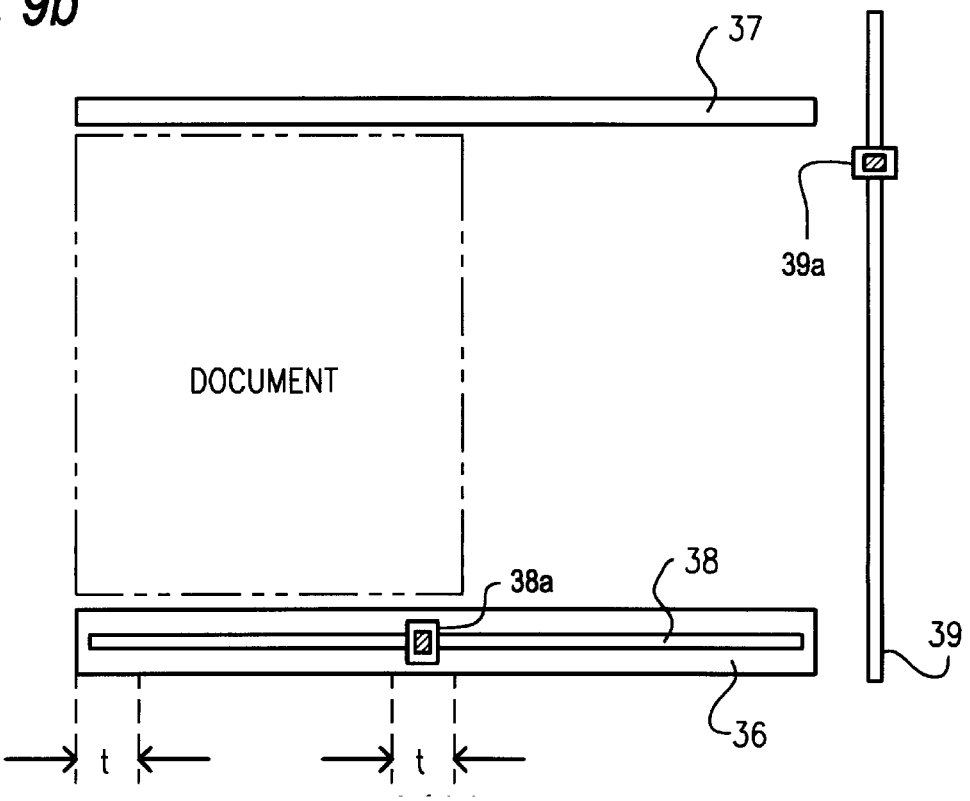

FIG. 5(*b*) shows the main routine of the CPU of FIG. 9(*a*). When processing is begun by the CPU, after initialization is performed (S11), various processes such as key input (S22), stapling position detection (S23), copying (S24), and other processes (collectively referred to as S25) are repeatedly performed within a time period that comes to an end in step S26 and is set by means of an internal timer that is repeatedly set in step S21.

Figure 6:
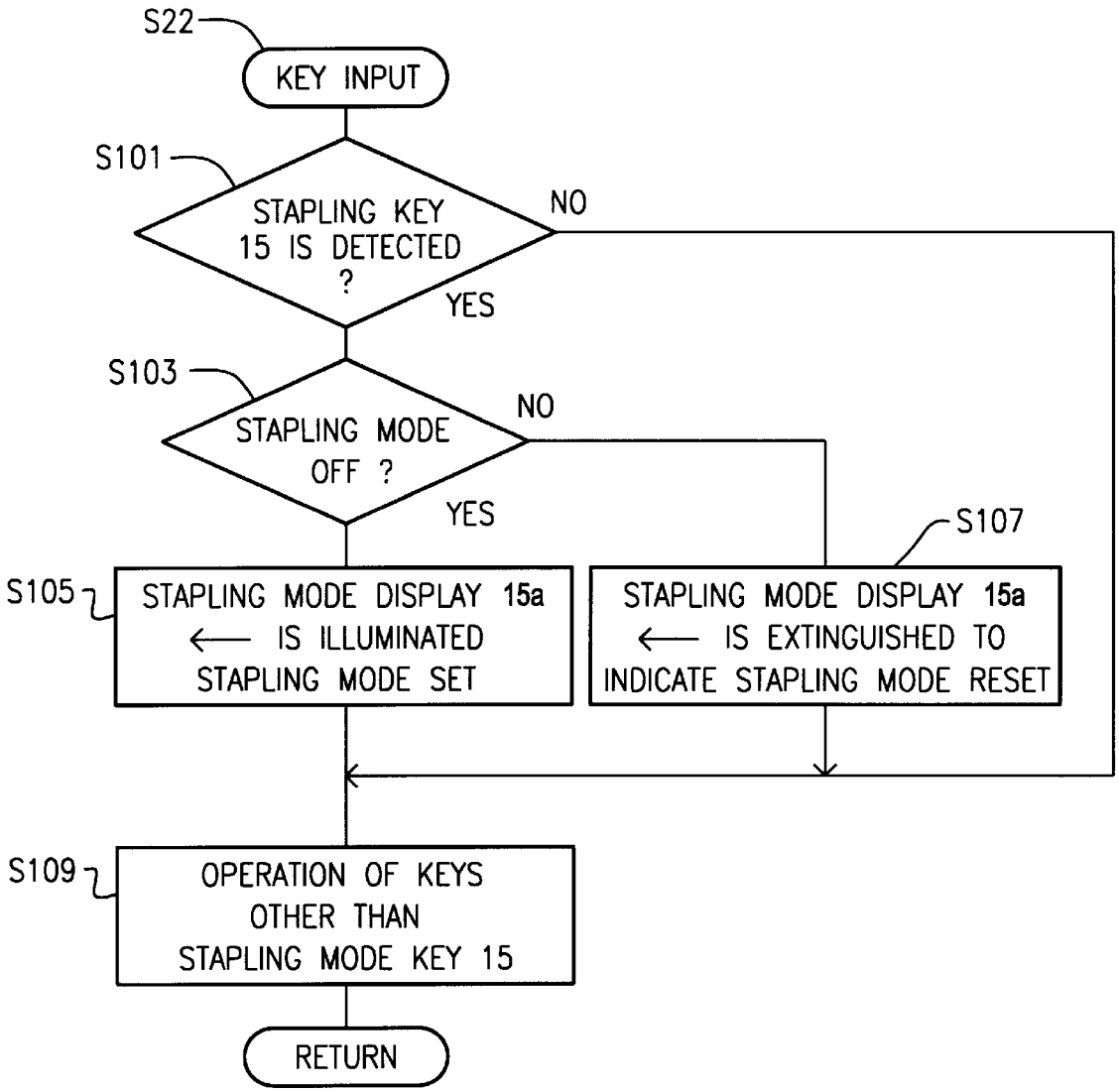
FIG. 6 is a flow chart showing the key input subroutine included in FIG. 5(*b*).

Key input subroutine: FIG. 6

In the key input subroutine, processing corresponding to key input from the various keys on operation panel 10 is performed. For example, if the operation of stapling mode key 15 is detected (YES in S101), it is determined whether or not the mode or status currently in effect is stapling mode, and if it is not stapling mode (YES in S103), stapling mode is set, and stapling mode display 15*a* that indicates that said mode is in effect is illuminated (S105). If the current mode or status is stapling mode, (NO in S103), stapling mode is cleared, and stapling mode display 15*a* is extinguished to indicate this (S107). Step S109 is a step indicating processes corresponding to the operation of keys other than stapling mode key 15.

Figure 7:
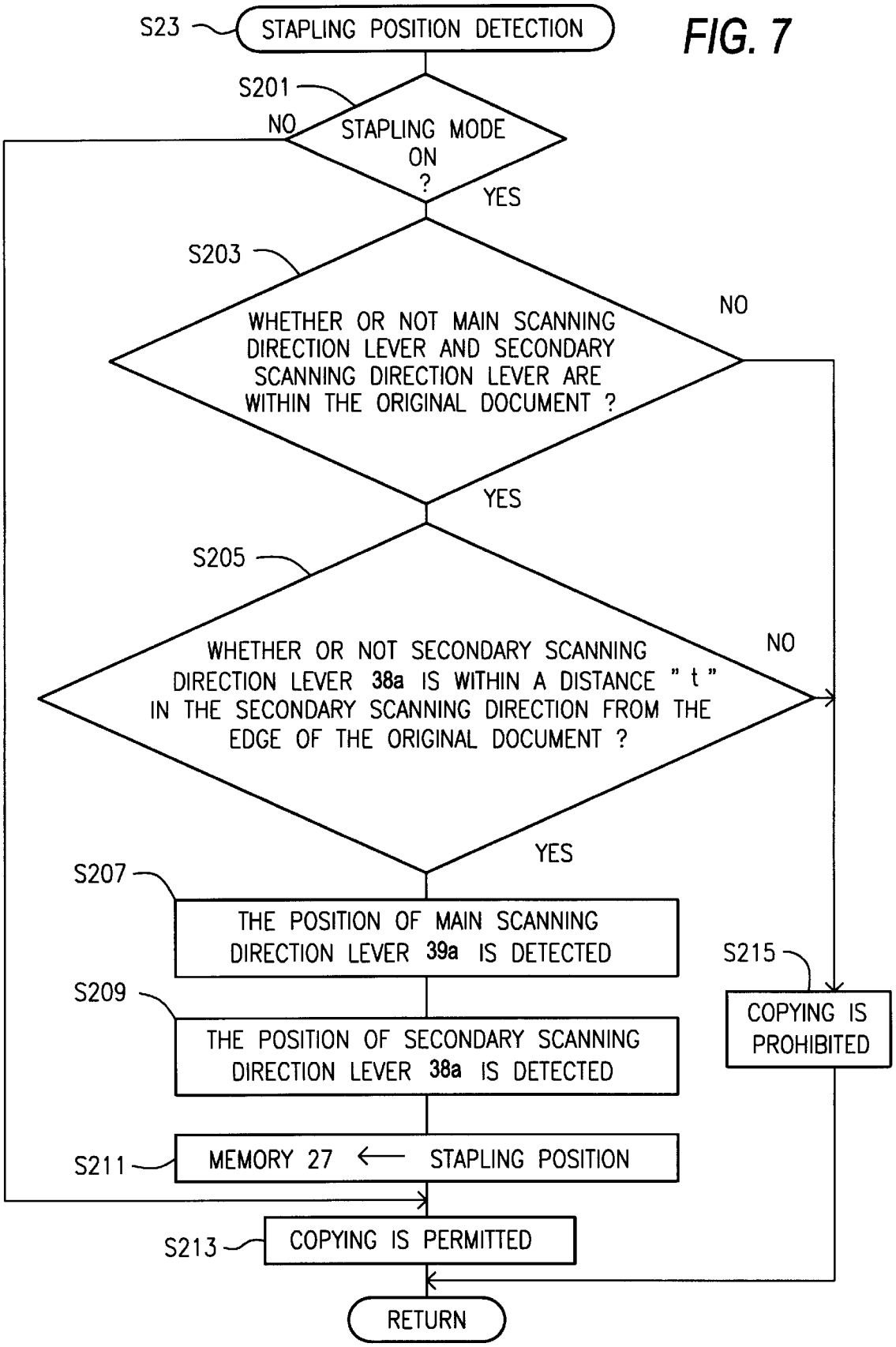
FIG. 7 is a flow chart showing the stapling position detection subroutine included in FIG. 5(*b*).

Stapling position detection subroutine: FIG. 7

In the stapling position detection subroutine, the stapling position coordinates are determined based on the values detected regarding levers 38*a* and 39*a*, and are then stored in memory 27. Where the position designated by means of levers 38*a* and 39*a* falls outside the original document area or is a position to which stapler 70 cannot be moved, copying is thereafter prohibited.

It is first determined whether or not stapling mode is in effect. If it is determined that stapling mode is in effect (YES in S201), it is then determined in S203 whether or not main scanning direction lever 39*a* and secondary scanning direction lever 38*a* are within the original document area. In other words, it is determined whether or not the stapling position designated as the intersecting coordinates of lever 39*a* and lever 38*a* is within the original document area. If either or both of the levers falls outside the original document area (NO in S203), copying is prohibited because stapling cannot be performed (S215).

Where both main scanning direction lever 39*a* and secondary scanning direction lever 38*a* are within the original document area (YES in S203), it is determined in S205 whether or not secondary scanning direction lever 38*a* is within distance t in the secondary scanning direction from the edge of the original document. In other words, the determination of step S205 is performed because in the case of this copying machine, stapler 70 can be moved only in the main scanning direction as shown in FIG. 3, while it is fixed with respect to the secondary scanning direction, and therefore stapling can be performed only within distance t from the edge of the paper. If the determination reached in step S205 is 'NO', copying is prohibited in step S215 because stapling cannot be performed. The reason that distance t is shown from both the leading edge and the trailing edge of the original document in FIG. 9(*b*) is that stapling can be performed to either edge by either rotating or not rotating the image 180 degrees. This operation will be explained in detail below.

Where both main scanning direction lever 39*a* and secondary scanning direction lever 38*a* are inside the original document area (YES in S203) and secondary scanning direction lever 38*a* is within secondary scanning direction distance t from either edge of the original document (YES in S205), stapling can be performed, and therefore the position of intersection of said levers, which comprises the coordinates of the stapling position, is determined based on the values detected regarding main scanning direction lever 39*a* and secondary scanning direction lever 38*a* (S207, S209), and is then stored in memory 27 in step S211. Copying is then permitted in step S213 as far as stapling is concerned. In other words, step S213 is not a step in which prohibition of copying due to other factors that are not mentioned in this application is cleared. If it is determined in said step S201 that stapling mode is not in effect (NO in S201), copying is naturally permitted in step S213 as far as stapling is concerned.

Figure 8:
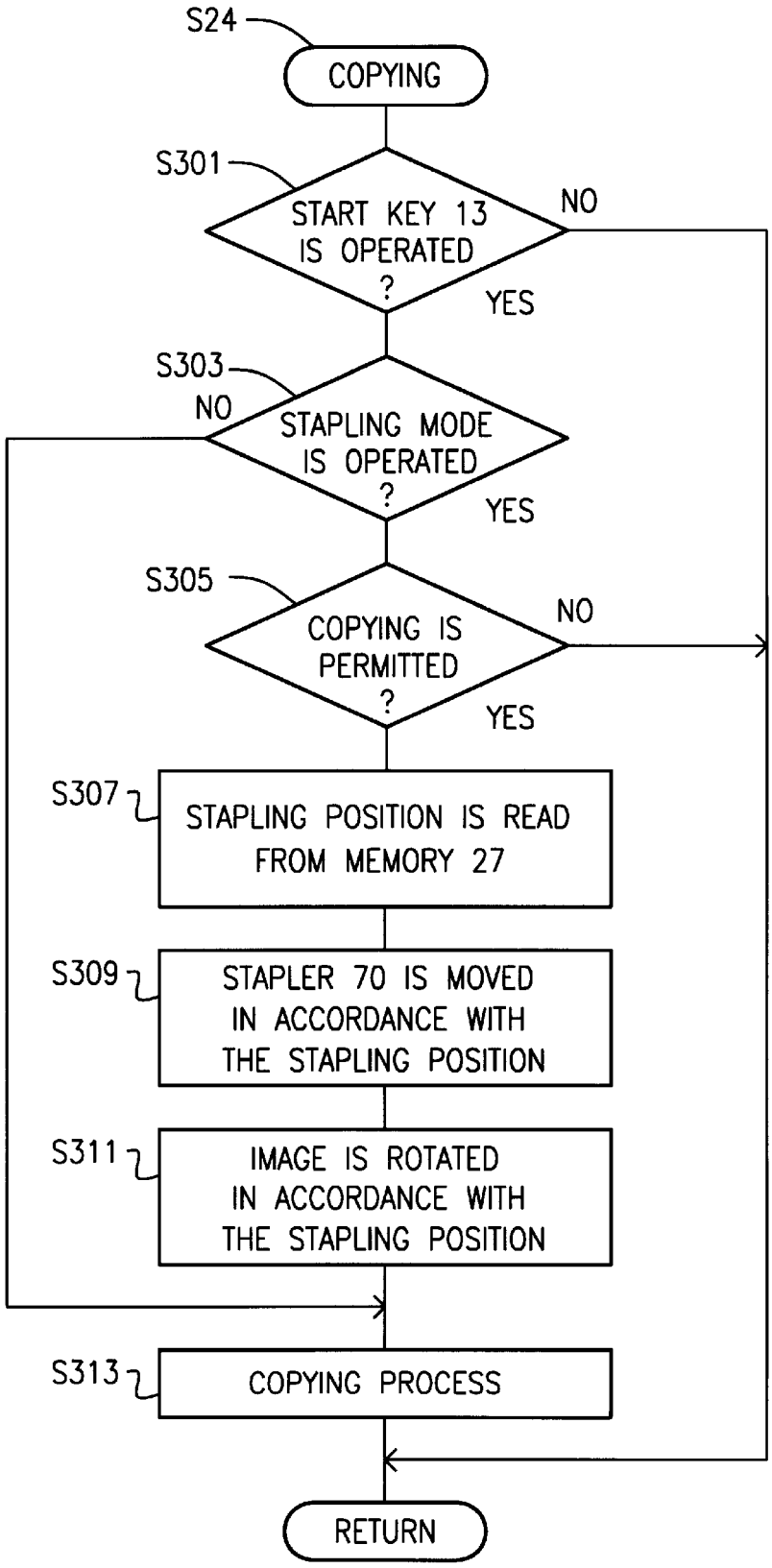
FIG. 8 is a flow chart showing the copy subroutine included in FIG. 5(*b*).

Copy subroutine: FIG. 8

When start key 13 is operated (YES in S301), it is determined in step S303 whether or not stapling mode has been set. If it is determined that stapling mode has not been set (NO in S303), the CPU proceeds directly to step S313. Step S313 is a step that collectively indicates all of the processes necessary to perform the copying sequence. Because these processes are in the public domain, their explanation will be omitted here.

If it is determined in step S303 that stapling mode is set (YES in S303), the CPU proceeds to step S305, in which it is determined whether or not copying is permitted. In other words, it is determined whether or not copying was prohibited in step S215 during said stapling position detection subroutine. If copying is prohibited (NO in S305), the CPU returns immediately to the main routine. When this occurs, the input from start key 13 is ignored. It is also acceptable if the fact that copying is prohibited because stapling cannot be performed, as well as the reason that stapling cannot be performed, is displayed on operation panel 10.

Where it is determined in step S305 that copying is not prohibited (YES in S305), the stapling position coordinates are read out from memory 27 in step S307, and stapler 70 is moved to the position designated by means of said stapling position coordinates in step S309. That is, motor M2 is driven so that stapler 70 is moved to the position designated by means of the read stapling position coordinates.

Where the relative positional relationship between the recorded image and the actual stapling position cannot be set to be identical to the relative positional relationship between the original document image and the designated stapling position solely by moving stapler 70, an instruction to rotate the image is issued to image memory 25 in step S311. In response to this instruction, image memory 25 rotates the image 180 degrees and outputs the rotated image for image formation. The CPU then proceeds from step S311 to step S313.

Figure 10:
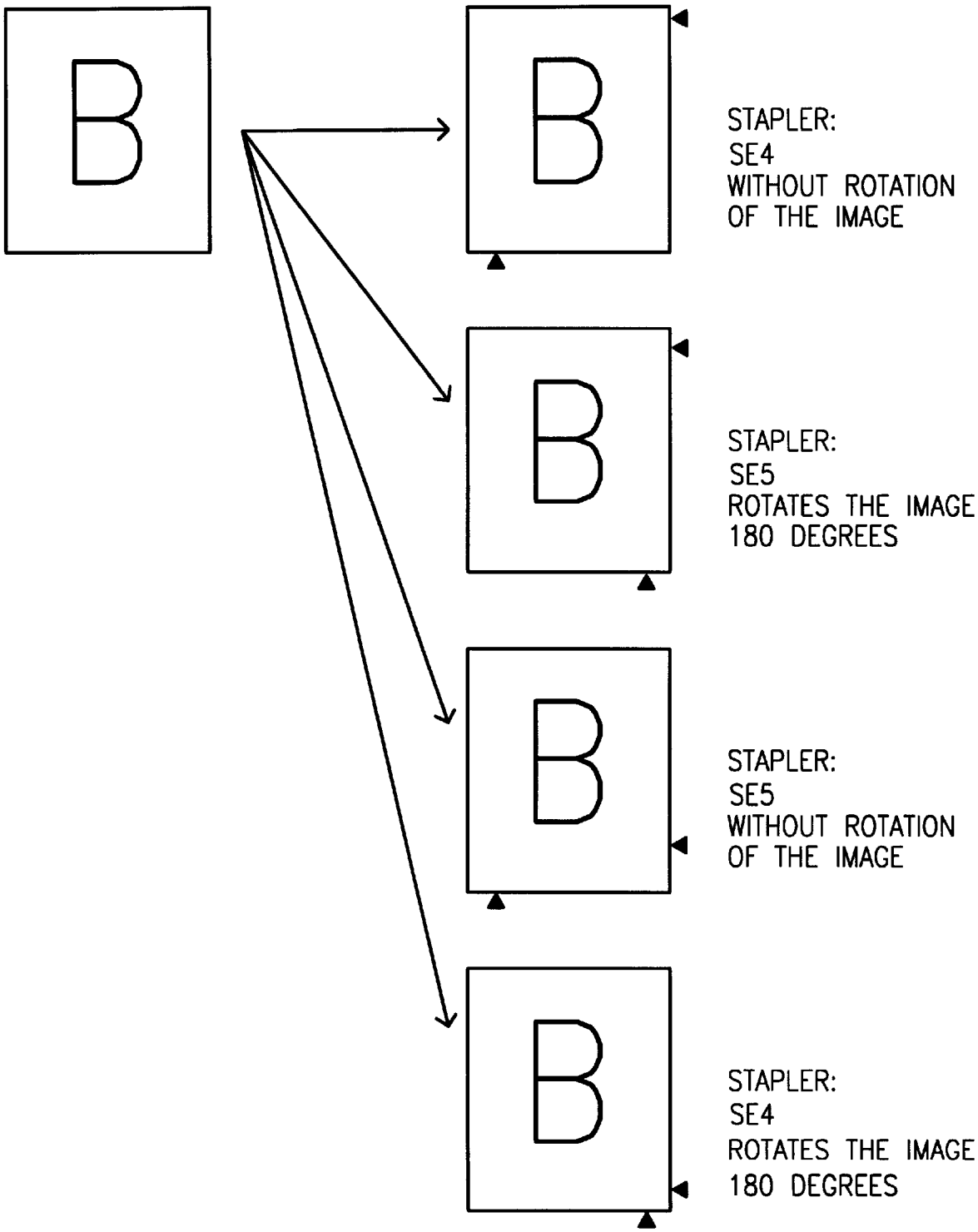
FIG. 10 is a drawing to explain the original document and the designation of the stapling position.

For example, in the case of the top example in the right-hand column in FIG. 10, the upper left corner of the original document image is designated as the stapling position and the recording sheet is housed in stapling tray 55 such that the left edge of the image shown in the drawing will be next to the stopper, and as a result, stapling is possible without rotation of the image. However, in the case of the second example from the top in the right hand column, because the upper right corner of the original ducument image is designated as the stapling position and the recording sheet is housed in stapling tray 55 such that the left edge of the image in the drawing would be next to the stopper if the image were not rotated, it is necessary to rotate the image 180 degrees so that the recording sheet will be housed in stapling tray 55 such that the upper right corner of the image designated as the stapling position will be next to the stopper. In the case of the third example from the top in the right-hand column, because the lower left corner of the original document image is designated as the stapling position, rotation is not necessary, as in the top example, but in the bottom example in the right-hand column, the lower right corner of the original document image is designated as the stapling position, and therefore the image must be rotated 180 degrees, as in the second example. The position of stapler 70 is indicated for each of these examples.

As previously indicated, the apparatus described above is an image forming apparatus that reads an original document image and records the image on a recording sheet, wherein said apparatus has a stapling position designating device by which the operator designates the stapling position while visually checking it against the original document (image) set in the original document tray, a device that seeks coordinate data regarding the stapling position designated by means of the stapling position designating device, a device that rotates the image in the image memory if necessary based on the relationship between the stapling position coordinate data and the possible range of movement of the stapler, and a device that sets the stapler so that stapling is possible at the position designated by means of the stapling position coordinate data.

The apparatus described above involves an apparatus in which stapler 70 can be moved only in the main scanning direction, but the present invention may be similarly applied in an apparatus in which stapler 70 can be moved only in the secondary scanning direction. In the case of an apparatus in which stapler 70 can be moved in the main and secondary scanning directions, stapling can be performed without rotating the image. Moreover, the apparatus described above involved an apparatus in which only one stapling position was designated, but the present invention may be similarly applied in an apparatus in which two or more stapling positions are designated. Further, the apparatus described above involved an apparatus in which the stapling position referred only to an original document set in original document tray 31 of automatic original document feeder 30, but a construction is also possible in which the stapling position refers to an original document that is set on platen glass 21.

The apparatus described above pertains to a copying machine, but the present invention may be similarly applied to a system comprising a separate image reading unit and printing unit. The present invention may also be similarly applied where the stapling position is designated with regard to an image displayed on a computer display and the designated stapling position is output to the printer together with the image data so that stapling is performed at a corresponding position on the recorded image.

In the present invention, stapling is performed such that the relative positional relationship between the designated stapling position, which is designated with reference to the original document image, and the original document image will be the same as the relative positional relationship between the actual stapling position and the recorded image, and consequently, stapling can be performed without error at the desired position, taking into consideration the image on the recording sheet. In addition, difficult judgement is not necessary in designating the stapling position, and any position can be designated via a simple operation.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

an image forming device for recording an original document on a sheet of recording medium;

a designating device for designating a stapling position with reference to the original document by visually checking a stapling position of the original document; and a stapling device for binding recording sheets at a position on said sheets corresponding to the stapling position designated by said designating device.

2. The image forming apparatus as claimed in claim 1, further comprises:

an image reader obtaining an image data of the original document;

an image data memory storing the image data;

a stapling data memory storing the coordinate data and a stapler data which indicates a possible range of movement of the stapler; and a device that rotates the image in the image data memory based on the relationship between the coordinate data and the stapler data.

3. An image forming apparatus, comprising:

an image forming device for recording an original document on a sheet of recording medium;

a designating device for designating a stapling position with reference to the original document;

a stapling device for binding recording sheets at a position on said sheets; corresponding to the stapling position designated by said designating device:

an image reader for obtaining image data of the original document;

an image data memory storing the image data;

a stapling data memory storing the coordinate data and stapler data which indicate a possible range of movement of the stapler; and a prohibiting device that prohibits the image forming of the image forming device based on a relationship between the coordinate data and the stapler data.

4. A stapling apparatus comprising:

an original document tray on which an original document is set;

a stapling position designating device for designating a stapling position of recording sheets by visually checking a stapling position of the original document set on the original document tray;

a seeking device for seeking coordinate data regarding the stapling position of the recording sheets designated by the stapling position designating device; and a stapling device which sets a stapler so that stapling is carried out at a position designated by the stapling position coordinate data.

5. The stapling apparatus as claimed in claim 4, further comprises an image reader obtaining an image data of the original document;

an image data memory storing the image data;

a stapling data memory storing the coordinate data and a stapler data which indicates a possible range of movement of the stapler; and a device that rotates the image in the image data memory based on the relationship between the coordinate data and the stapler data.

6. The stapling apparatus as claimed in claim 4, further comprises an image reader obtaining an image data of the original document;

an image data memory storing the image data;

a stapling data memory storing the coordinate data and a stapler data which indicates a possible range of movement of the stapler; and a device that prohibits the stapler to be performed based on the relationship between the coordinate data and the stapler data.

7. An image forming apparatus comprising:

an original document tray which is set an original document thereon;

an image reader obtaining an image data of the original document;

an image forming device forming an image on recording sheets based on the image data;

a stapling position designating device designating a stapling position while visually checking the stapling position against the original document set in the original document tray;

a seeking device seeking a coordinate data regarding the stapling position designated by the stapling position designating device; and a stapling device that binds the recording sheets at a position on said sheets that corresponds to the stapling position designated by said designating device.

8. The stapling apparatus as claimed in claim 7, further comprises an image data memory storing the image data obtained by the image reader;

a stapling data memory storing the coordinate data and a stapler data which indicates a possible range of movement of the stapler; and a device that rotates the image in the image data memory based on the relationship between the coordinate data and the stapler data.

9. The stapling apparatus as claimed in claim 7, further comprises an image data memory storing the image data obtained by the image reader;

a stapling data memory storing the coordinate data and a stapler data which indicates a possible range of movement of the stapler; and a device that prohibits the image forming device to be performed based on the relationship between the coordinate data and the stapler data.

10. The stapling apparatus as claimed in claim 9, further comprises a display device displays the prohibition of the stapler or the image forming device.

11. The stapling apparatus as claimed in claim 9, wherein the prohibition device prohibits the image forming device when the coordinate data indicates is out range of a predetermined value of the stapler data which indicates the possible range of movement of the stapler.

12. An image forming apparatus comprising:

an original document tray which is set an original document thereon;

an image reader obtaining an image data of the original document;

an image forming device forming an image on recording sheets based on the image data;

a stapling position designating device designating a stapling position while visually checking the stapling position against the original document set in the original document tray;

a seeking device seeking a coordinate data regarding the stapling position designated by the stapling position designating device;

a mode selecting device selecting a stapling mode or a non-stapling mode; and a stapling device that binds the recording sheets at a position on said sheets that corresponds to the stapling position designated by said designating device when the a stapling mode is selected by the mode selecting device.

13. The stapling apparatus as claimed in claim 12, further comprises an image data memory storing the image data obtained by the image reader;

a stapling data memory storing the coordinate data and a stapler data which indicates a possible range of movement of the stapler; and a device that rotates the image in the image data memory based on the relationship between the coordinate data and the stapler data.

14. The stapling apparatus as claimed in claim 12, further comprises an image data memory storing the image data obtained by the image reader;

a stapling data memory storing the coordinate data and a stapler data which indicates a possible range of movement of the stapler; and a device that prohibits the image forming device to be performed based on the relationship between the coordinate data and the stapler data.

15. The stapling apparatus as claimed in claim 12, further comprises a display device displays the prohibition of the stapler or the image forming device.

16. The stapling apparatus as claimed in claim 15, wherein the prohibition device prohibits the image forming device when the coordinate data indicates is out range of a predetermined value of the stapler data which indicates the possible range of movement of the stapler.

* * * * *